US009316974B2

(12) United States Patent
Yamaguchi et al.

(10) Patent No.: US 9,316,974 B2
(45) Date of Patent: Apr. 19, 2016

(54) FIXING DEVICE HAVING THERMALLY-CONDUCTIVE MEMBER CONNECTED TO THERMO-ELECTRIC CONVERSION ELEMENT, IMAGE FORMING DEVICE, AND INDUCTION HEATING DEVICE

(71) Applicant: Konica Minolta, Inc., Chiyoda-ku (JP)

(72) Inventors: Hiroshi Yamaguchi, Toyokawa (JP); Isao Watanabe, Toyohashi (JP); Yasutaka Tanimura, Nara (JP); Hiroshi Hiraguchi, Toyokawa (JP); Mineo Yamamoto, Toyokawa (JP); Toshinori Inomoto, Toyokawa (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/483,609

(22) Filed: Sep. 11, 2014

(65) Prior Publication Data

US 2015/0071689 A1 Mar. 12, 2015

(30) Foreign Application Priority Data

Sep. 12, 2013 (JP) ..... 2013-189649

(51) Int. Cl.
*G03G 15/20* (2006.01)

(52) U.S. Cl.
CPC ..... *G03G 15/2053* (2013.01); *G03G 15/2064* (2013.01); *G03G 2215/2025* (2013.01)

(58) Field of Classification Search
CPC ..... G03G 15/2053; G03G 15/2017; G03G 2215/2025; F01N 5/025
USPC ..... 399/329
See application file for complete search history.

(56) References Cited

U.S. PATENT DOCUMENTS 5,419,780 A * 5/1995 Suski ..... 136/205
6,883,929 B2 * 4/2005 Dowling ..... 362/192

(Continued)

FOREIGN PATENT DOCUMENTS

JP 2005-084127 A 3/2005
JP 2006-313200 A 11/2006

(Continued)

OTHER PUBLICATIONS

Notification of Reasons for Refusal dated Aug. 18, 2015 issued by the Japanese Patent Office in the corresponding Japanese Patent Application No. 2013-189649 and English language translation (6 pages).

*Primary Examiner* — Clayton E LaBalle
*Assistant Examiner* — Trevor J Bervik
(74) *Attorney, Agent, or Firm* — Buchanan Ingersoll & Rooney PC

(57) ABSTRACT

A fixing device thermally fixes an unfixed image onto a sheet through heat of a heating body that is heated through electromagnetic induction, the fixing device including an excitation coil generating flux for heating the heating body; one or more core members disposed opposite the heating body with respect to the excitation coil; a thermo-electric conversion element disposed farther from the excitation coil than the core members; and a thermally conductive member connected to the excitation coil and to a heat-absorbing face of the thermo-electric conversion element, transferring heat from the excitation coil to the thermo-electric conversion element.

14 Claims, 7 Drawing Sheets

(56) References Cited

U.S. PATENT DOCUMENTS

| | | | | |
|---|---|---|---|---|
| 7,103,292 | B2 * | 9/2006 | Hirst et al. | 399/33 |
| 2006/0187645 | A1 * | 8/2006 | Numata | 361/704 |
| 2006/0289482 | A1 | 12/2006 | Nojima | |
| 2007/0095820 | A1 * | 5/2007 | Kinouchi et al. | 219/619 |
| 2012/0219312 | A1 * | 8/2012 | Yuasa et al. | 399/69 |
| 2013/0148995 | A1 * | 6/2013 | Yoshikawa et al. | 399/69 |

FOREIGN PATENT DOCUMENTS

| | | | |
|---|---|---|---|
| JP | 2012-014845 | A | 1/2012 |
| JP | 2013-171169 | A | 9/2013 |

* cited by examiner

FIXING DEVICE HAVING THERMALLY-CONDUCTIVE MEMBER CONNECTED TO THERMO-ELECTRIC CONVERSION ELEMENT, IMAGE FORMING DEVICE, AND INDUCTION HEATING DEVICE

This application is based on application No. 2013-189649 filed in Japan, the contents of which are hereby incorporated by reference.

BACKGROUND OF THE INVENTION (1) Field of the Invention

The present disclosure relates to a fixing device using electro-magnetic induction heating, to a image forming device equipped with the fixing device, and to an induction heating device.

(2) Description of the Related Art

Recently, image forming devices such as printers have frequently used an induction heating fixing device in order to lower energy consumption relative to halogen heating fixing devices.

In such an induction heating fixing device, electric power supplied to the excitation coil produces magnetic flux that heats a heating body such as a heating layer of a fixing roller.

The excitation coil is also heated through Joule heating in the coils itself, caused by the supply of electricity. However, this is a waste of energy in that there is no simple way to dispose of this heat.

In order to prevent this heat energy loss, the excess heat is conventionally used by a thermo-electric conversion element converting the thermal energy into electrical energy.

When attempting to reach a configuration in which heat produced by the excitation coil is converted into electrical energy by thermo-electric conversion elements, disposing the thermo-electric conversion elements as close to the excitation coil as possible is beneficial from a thermo-electric conversion efficacy perspective.

However, when the thermo-electric conversion elements are close to the excitation coil, such as when a heat-absorbing face of the thermo-electric conversion element is in direct contact with the wiring of the excitation coils, the effect of flux poses problems such as causing malfunctions or decreasing the thermo-electric conversion efficacy by heating of the entire thermo-electric conversion element.

These problems are not limited to fixing devices used in image forming devices, but also occur in other induction heating devices, such as induction heating cooking devices.

SUMMARY OF THE INVENTION

The present disclosure aims to provide a fixing device, using a configuration where induction heating is used to heat a heating body, that effectively uses thermo-electric conversion elements to convert heat produced by an excitation coil into electrical energy, an image forming device incorporating this fixing device, and an induction heating device applying induction heating to a heating body.

In order to achieve this aim, a fixing device is provided, thermally fixing an unfixed image onto a sheet through heat of a heating body that is heated through electromagnetic induction, the fixing device comprising: an excitation coil generating flux for heating the heating body; one or more core members disposed opposite the heating body with respect to the excitation coil; a thermo-electric conversion element disposed farther from the excitation coil than the core members; and a thermally conductive member connected to the excitation coil and to a heat-absorbing face of the thermo-electric conversion element, transferring heat from the excitation coil to the thermo-electric conversion element.

Also, an image forming device forming an unfixed image on a sheet, the image forming device having a fixing unit thermally fixing the unfixed image onto the sheet through heat of a heating body that is heated through electromagnetic induction, the fixing unit comprising: an excitation coil generating flux for heating the heating body; one or more core members disposed opposite the heating body with respect to the excitation coil; a thermo-electric conversion element disposed farther from the excitation coil than the core members; and a thermally conductive member connected to the excitation coil and to a heat-absorbing face of the thermo-electric conversion element, transferring heat from the excitation coil to the thermo-electric conversion element.

Further, an induction heating device heating a heating body through electromagnetic induction, comprising: an excitation coil generating flux for heating the heating body; one or more core members disposed opposite the heating body with respect to the excitation coil; a thermo-electric conversion element disposed farther from the excitation coil than the core members; and a thermally conductive member connected to the excitation coil and to a heat-absorbing face of the thermo-electric conversion element, transferring heat from the excitation coil to the thermo-electric conversion element.

BRIEF DESCRIPTION OF THE DRAWINGS

These and the other objects, advantages and features of the invention will become apparent from the following description thereof taken in conjunction with the accompanying drawings which illustrate a specific embodiment of the invention.

In the drawings.

DESCRIPTION OF THE PREFERRED EMBODIMENT

The following describes a tandem colour printer (hereinafter simply termed printer) according to an Embodiment of the fixing device and the image forming device pertaining to the present disclosure.

(1) Printer Configuration

Figure 1:
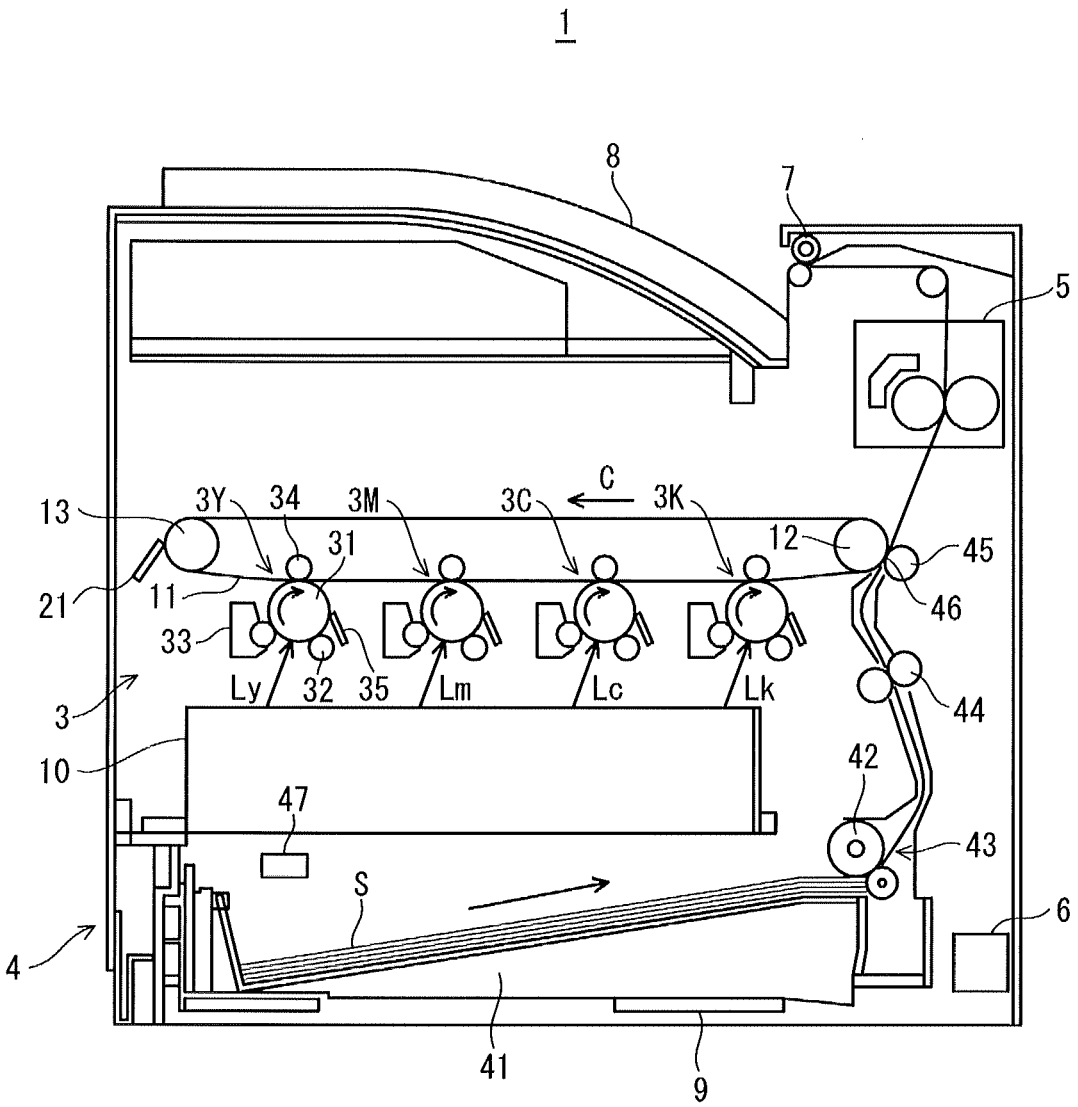
FIG. 1 shows the configuration of a printer pertaining to the Embodiment.

FIG. 1 shows the configuration of a printer 1 pertaining to the Embodiment.

As shown, the printer 1 includes an image forming unit 3, a feed unit 4, a fixing unit 5, and a control unit 6.

The printer 1 receives a print instruction from a (non-diagrammed) outside terminal device via a network (e.g., a local area network, hereinafter LAN), forms a toner image in yellow, magenta, cyan, and black in accordance with the print instruction, then creates a full-colour image on a recording sheet through overlay transfer of these toner images, thus executing a print process (also termed a print job) onto the recording sheet. The reproduction colours yellow, magenta, cyan, and black are hereinafter respectively abbreviated with the signs Y, M, C, and K, these signs being appended to the reference signs of components related to colour.

The image forming unit 3 includes imaging units 3Y, 3M, 3C, and 3K, an exposure unit 10, an intermediate transfer belt 11, a secondary transfer roller 45, and so on.

Imaging unit 3Y includes a photosensitive drum 31 having a charger 32, a developer 33, a primary transfer roller 34, and a cleaner 35 for cleaning the photosensitive drum 31, all disposed at the periphery thereof. A yellow toner image is created on the photosensitive drum 31.

Other imaging units 3M, 3C, and 3K are also configured fundamentally similarly to imaging unit 3Y, differing only in the colour corresponding to the photosensitive drum 31. The reference signs are omitted for imaging units 3M, 3C, and 3K.

The intermediate transfer belt 11 is an endless belt overspanning a driving roller 12 and a driven roller 13 and driven to circulate in the direction indicated by arrow C. A cleaner 21 is provided in the vicinity of the driven roller 13 for cleaning any remaining toner from the surface of the intermediate transfer belt 11.

The exposure unit 10 includes a light-emitting element, which is a laser diode or similar. The exposure unit 10 produces laser light Ly, Lm, Lc, Lk for forming the image in the colours Y, M, C, K in accordance with a drive signal from the control unit 6 by scanning the respective photosensitive drums 31 of the imaging units 3Y, 3M, 3C, and 3K, charged by the charger 32. Exposure to the laser light causes the photosensitive drum 31 of each imaging unit 3Y, 3M, 3C, 3K to form a latent static image.

For each imaging unit 3Y, 3C, 3M, 3K, the latent static images formed on the photosensitive drum 31 are developed by the respective developer 33, thus forming toner images in the corresponding colours on each photosensitive drum 31.

The toner images on each photosensitive drum 31 sequentially undergo a primary transfer onto the intermediate transfer belt 11, performed by the primary transfer roller 34 facing the photosensitive drum 31 with the intermediate transfer belt 11 therebetween. During the primary transfer, control is performed such that the toner images in each colour are transferred to the same position on the intermediate transfer belt 11 by using the imaging unit 3Y as a reference and offsetting the timing of imaging by the other imaging units 3M, 3C, and 3K. Accordingly, a colour image is formed on the intermediate transfer belt 11.

The feed unit 4 includes a paper feed cassette 41 containing recording sheets S, a pick-up roller 42 picking up the recording sheets S in the paper feed cassette 41 one by one for passage into a transport path 43, and a timing roller 44 for adjusting the timing at which each recording sheet is picked up and sent to a secondary transfer position 46.

Also, a dehumidifying heater 9 is provided under the paper feed cassette 41, paired with a humidity sensor 47 provided in the vicinity of the paper feed cassette 41.

When the humidity sensor 47 detects high humidity in the vicinity of the paper feed cassette 41, the dehumidifying heater 9 warms the paper feed cassette 41 from the bottom, thus enabling dehumidification of the paper feed cassette 41 such that humidity does not reach the recording sheets S. The operations of the dehumidifying heater 9 are controlled by the control unit 6.

The timing roller 44 transports the recording sheet S to the secondary transfer position 46 in accordance with the timing at which the toner images, which have been successively overlaid onto the intermediate transfer belt 11, is transferred to the secondary transfer position 46. The toner images on the intermediate transfer belt 11 then undergo a secondary transfer as one onto the recording sheet S, performed by the secondary transfer roller 45 at the secondary transfer position 46. The recording sheet S having the toner images transferred thereon in the secondary transfer is then transported to the fixing unit 5.

The fixing unit 5 uses electromagnetic induction heating to thermally fix the toner images (i.e., unfixed images) onto the transported recording sheet S by applying heat and pressure. The thermally fixed recording sheet S is then taken to an exit tray 8 by an exit roller 7.

(2) Control Unit Configuration

Figure 2:
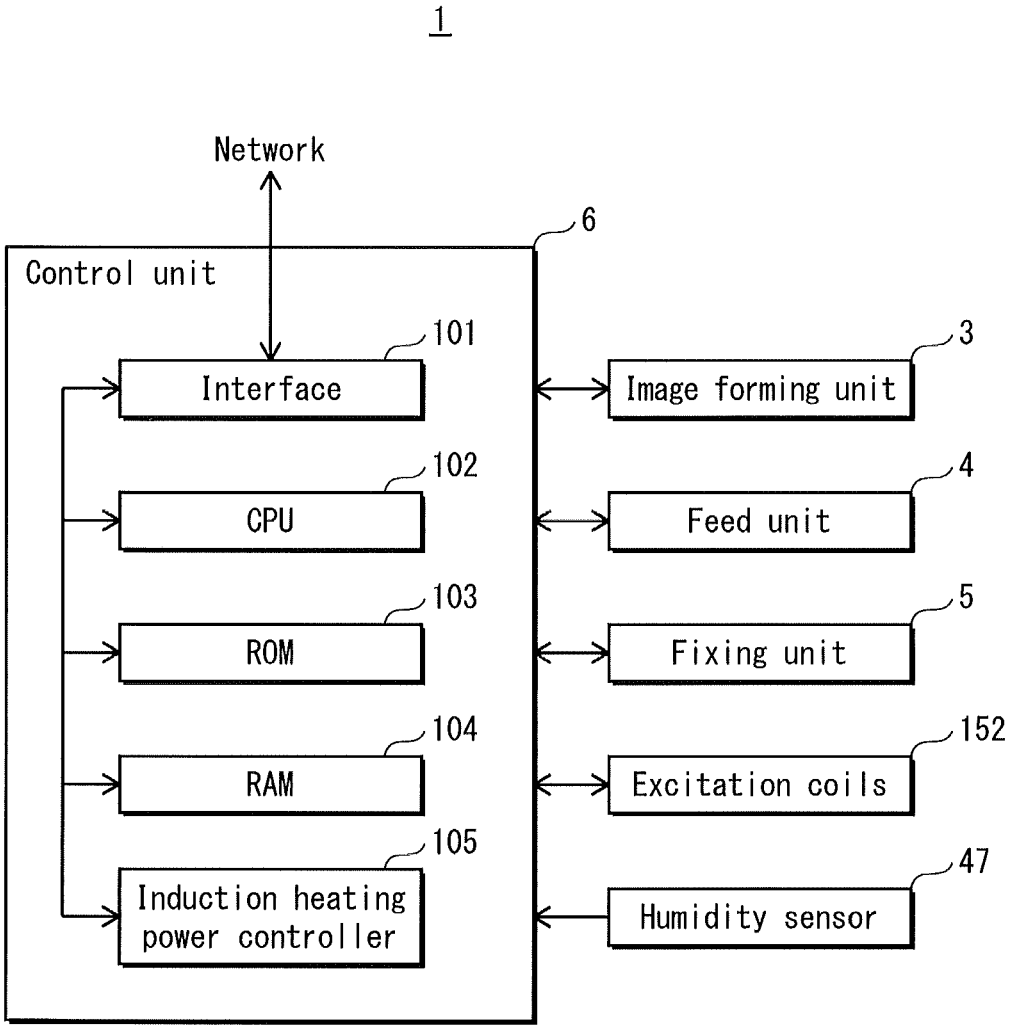
FIG. 2 is a block diagram showing the configuration of a control unit in the printer.

FIG. 2 is a block diagram showing the configuration of the control unit 6.

As shown, the control unit 6 includes a communication interface 101, a central processing unit (hereinafter, CPU) 102, read-only memory (hereinafter, ROM) 103, random access memory (hereinafter, RAM) 104, an induction heating power controller 105, and so on, the components being capable of communicating with each other.

The communication interface 101 is a network interface such as a LAN card or LAN board connected to the LAN, for example. The communication interface 101 communicates, via the network, with a terminal device also connected to the network.

The CPU 102 reads a required program from the ROM 103 and controls the image forming unit 3, the feed unit 4, and the fixing unit 5 to smoothly execute the print job.

The RAM 104 serves as a work area for the CPU 102.

Figure 3:
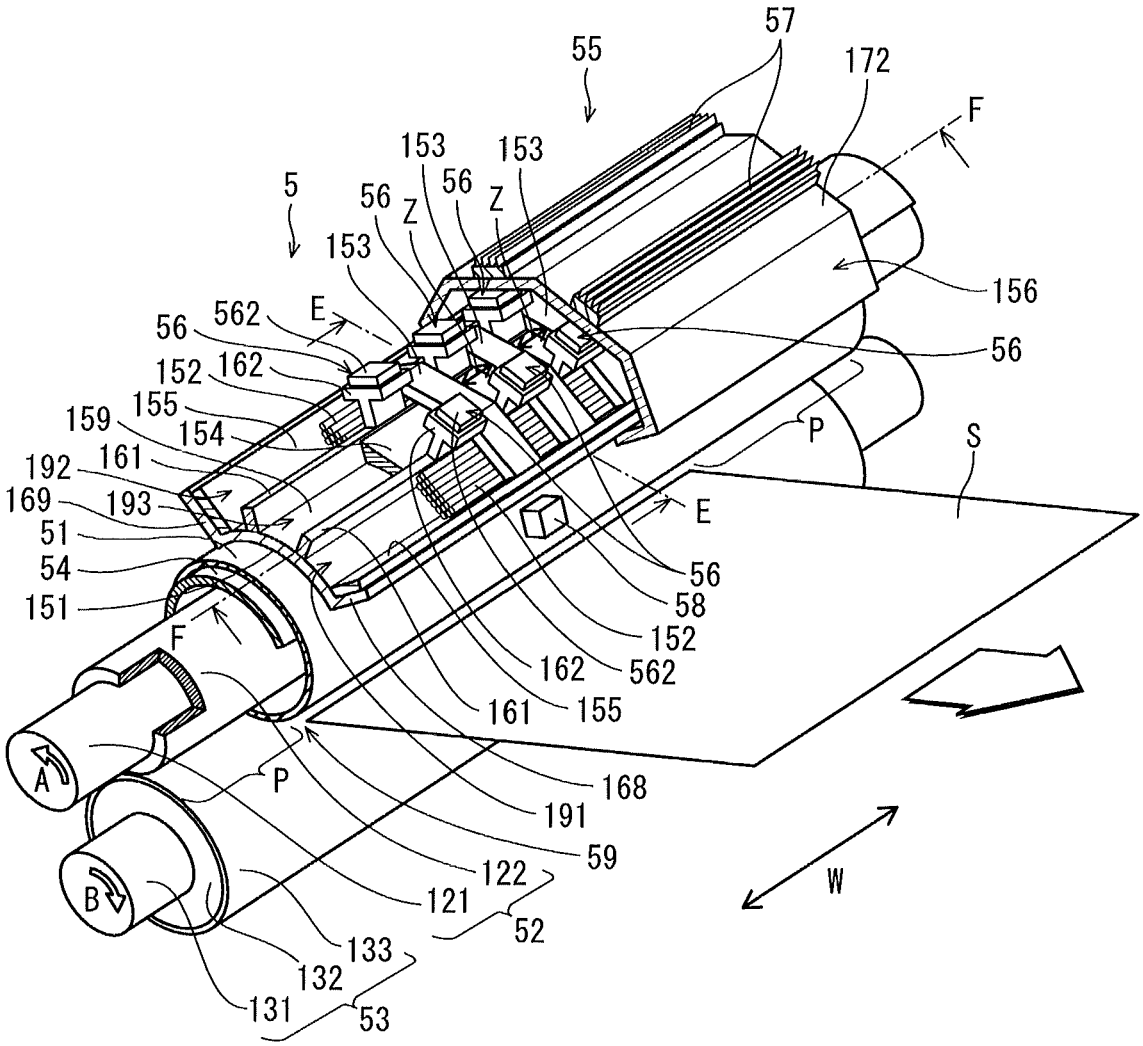
FIG. 3 is a partial cutaway perspective view diagram showing the configuration of a fixing unit.

The induction heating power controller 105 controls supply of electric power to excitation coil 152 in the fixing unit 5, thus maintaining a predetermined fixing temperature appropriate for fixing performed by a fixing belt 51 (see FIG. 3).

(3) Overall Fixing Unit Configuration

Figure 4A:
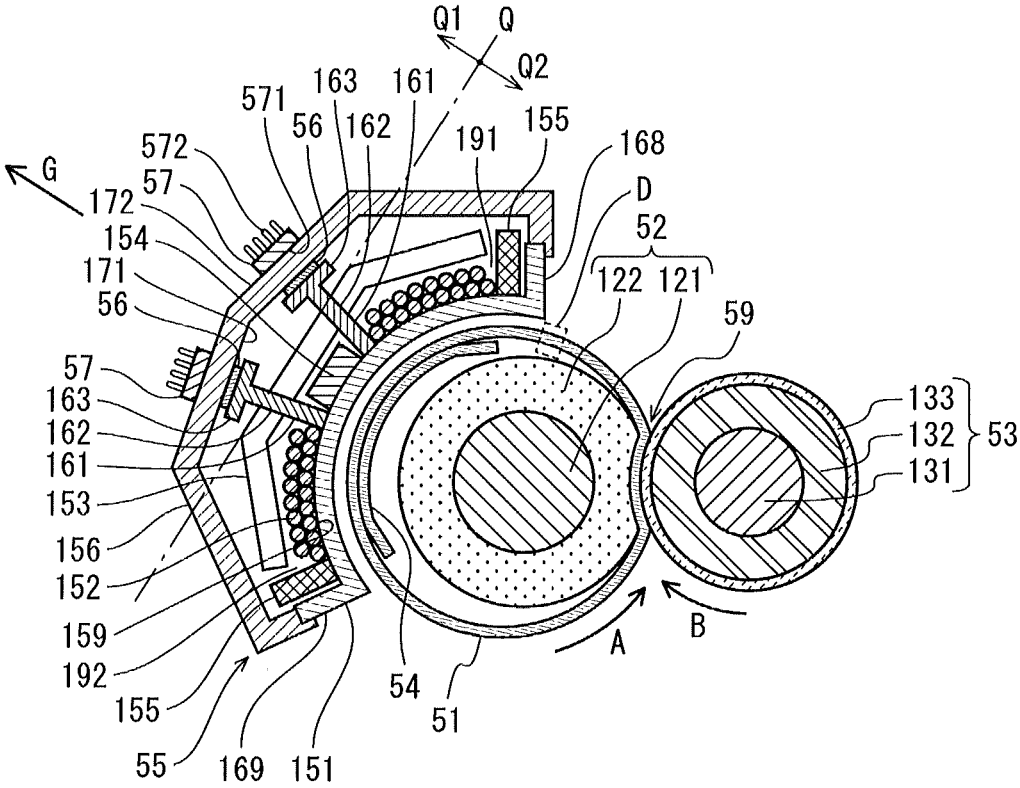
FIG. 4A is a cross-sectional view of the fixing unit taken along line E-E of FIG. 3.
Figure 4B:
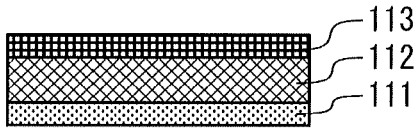
FIG. 4B is a cross-sectional diagram of a portion D of a fixing belt indicated in FIG. 4A.

FIG. 3 is a perspective diagram showing the configuration of the fixing unit 5. FIG. 4A is a cross-sectional view of the fixing unit 5 taken along line E-E of FIG. 3. FIG. 4B is a cross-sectional diagram of a portion D of the fixing belt 51 indicated in FIG. 4A. For ease of understanding, FIG. 3 illustrates the fixing unit 5 as being rotated 90° clockwise from the orientation shown in FIG. 1. Also, a portion of the fixing unit 5 has been cut away, and a non-sheet passing region of the fixing belt 51, in which the recording sheet S does not pass, is shown and indicated by the sign P.

As shown in FIGS. 3, 4A, and 4B, the fixing unit 5 includes the fixing belt 51, a fixing roller 52, a pressing roller 53, a guide plate 54, a flux generator 55, a plurality of thermoelectric conversion elements 56, a heat sink 57, and a thermistor 58.

The fixing belt 51 is an endless tubular belt driven to rotate in the direction indicated by arrow A. As shown in FIG. 4B, the fixing belt 51 is made up of a magnetic adjuster alloy layer 111, a heating layer 112, and a resilient layer 113, layered in the stated order such that a back surface of the magnetic adjuster alloy layer 111 is at the back and a top surface of the resilient layer 113 is at the front.

The fixing belt 51 has an inner diameter of approximately 40 mm, and is a shape-maintaining belt that is resilient and naturally maintains an approximately cylindrical shape. The fixing belt 51 has a width W (corresponding to a width-wise direction perpendicular to the transport direction of the recording sheet S) that is greater than a width of the largest size of recording sheet. FIG. 3 illustrates a case where a sheet that is one size smaller than the largest size is passing through a fixing nip 59.

The resilient layer 113 is a layer of silicone resin or the like having a thickness of approximately 200 μm.

The heating layer 112 is a layer of nickel or the like having a thickness of approximately 10 μm, generating heat through the magnetic flux produced by the flux generator 55.

The magnetic adjuster alloy layer 111 is a layer of an alloy of nickel and iron having a thickness of approximately 30 μm, with the property of changing from a magnetic body to a non-magnetic body when at or above a predetermined temperature (i.e., the Curie temperature) and reverting from a non-magnetic body to a magnetic body when the temperature drops. The specific configuration of the magnetic adjuster alloy layer 111 is described below.

The fixing roller 52 includes a core 121 that is long and cylindrical having a resilient layer 122 layered thereon, and is disposed within a rotational path (i.e., a circulation path) of the fixing belt 51. The core 121 is made of aluminium, stainless steel, or the like, while the resilient layer 122 is a thermally insulating layer of urethane resin or similar. The fixing roller 52 has an external diameter of approximately 35 mm.

The pressing roller 53 has a core 131 that is long and cylindrical having a resilient layer 132 and a separation layer 133 layered thereon in the stated order, disposed outside the rotational path of the fixing belt 51, and serving to press the fixing roller 52 through the fixing belt 51 from outside, so as to preserve the fixing nip 59 between the surface of the fixing belt 51 and the pressing roller 53.

The core 131 is made of aluminium or the like. The resilient layer 132 is a layer of silicone sponge resin or the like. The separation layer 133 is a coat of PFA (a tetrafluoroethylene-perfluoroalkoxyl vinyl ethylene compound), PTFE (polytetrafluoroethylene), or similar. The pressing roller 53 has an external diameter of approximately 35 mm.

The core 121 of the fixing roller 52 and the core 131 of the pressing roller 53 are each supported at both ends of an axial direction by a bearing member in a non-diagrammed frame, so as to be freely rotatable. The pressing roller 53 is driven to rotate in the direction of arrow B by drive force imparted thereto by a (non-diagrammed) drive motor. The fixing belt 51 and the fixing roller 52 are driven to rotate in the direction of arrow A by the rotation of the pressing roller 53.

The flux generator 55 includes a base 151, the excitation coil 152, main cores 153, a centre core 154, fringe cores 155, and a case cover 156. The flux generator 55 is located in the vicinity of the fixing belt 51, outside the rotational path thereof, along the width W of the fixing belt 51.

The base 151 is a plate member curving into an arc with respect to the rotational direction of the fixing belt 51 (hereinafter termed the belt rotational direction), made of resin or the like, and fixed at each width-wise end to the non-diagrammed frame. The position of the base 151 is adjusted so that a separation of approximately 2.5 mm is maintained between the base 151 and the surface of the fixing belt 51.

The base 151 has a face 159 opposite a face located near the fixing belt 51 on which bobbins 161 are arranged in two locations, at separation from the belt rotational direction. The bobbins 161 are plates standing up on the face 159 in the direction of arrow G (i.e., away from the fixing belt 51) (see FIG. 4A)). The bobbins 161 form protrusions that are elongated along the width direction.

The two bobbins 161 are distinct components from the base 151, each formed from thermally conductive electrically insulating resin through injection moulding or similar, affixed to the base 151 using an adhesive, fastening, or the like.

The thermally conductive electrically insulating resin is, for instance, Zi-ma inus from Sumitomo Osaka Cement Co., Ltd. The base 151 and the bobbins 161 may also be formed from the thermally conductive electrically insulating resin by moulding as a single component.

Also, side walls 168 and 169 are respectively provided at each belt rotational directional end of the base 151, so as to curve away from the position of the fixing belt 51.

The main cores 153, the centre core 154, and the fringe cores 155 are each formed of permalloy, ferrite, or a similar material with high magnetic permeability, and are supported by the base 151.

The centre core 154 and the fringe cores 155 are elongated along the width direction W.

The centre core 154 is disposed above the face 159 of the base 151 in a region 193 between the two bobbins 161, and being elongated along the width direction W.

The fringe cores 155 are provided as a pair, disposed over the face 159 of the base 151 and neighbouring the side walls 168 and 169, and is elongated along the width direction W.

The main cores 153 are provided in plurality, each being elongated in the belt rotational direction and curving with respect thereto. Each main core 153 is elongated to be oriented in the belt rotational direction, and is arranged along the width direction W with a predetermined separation Z from the other cores.

The excitation coil 152 is a wire rod (a conducting wire) that is coiled on itself, such that the excitation coil 152 is narrow in terms of the width direction W, and crosses the two bobbins 161 in the length direction. The excitation coil 152 is elongated in the length direction, to be longer than the fixing belt 51 is wide.

FIG. 3 shows a portion of the conducting wire (i.e., a wound coil) extending in the width direction W of the excitation coil 152 in a region between the main cores 153 and the face 159 of the base 151, in region 191 of the face 159 between one of the bobbins 161 and one of the fringe cores 155, and in region 192 between the other one of the bobbins 161 and the other one of the fringe cores 155.

Also, a non-diagrammed portion where the excitation coil 152 turns back on itself at each end with respect to the width direction W curves along an arc of the base 151, and is disposed in a region of the face 159 of the base 151 where the bobbins 161 are not located.

As shown in FIG. 4A, the fixing belt 51, the excitation coil 152, and the main cores 153 are arranged as indicated by arrow G in FIG. 4A, such that the main cores 153 is opposite the fixing belt 51 with the excitation coil 152 sandwiched therebetween. Also, the excitation coil 152 is located between the base 151 and the main cores 153.

The excitation coil 152 is connected to the induction heating power controller 105, which includes a (non-diagrammed) excitation coil drive circuit using a conventional high-frequency inverter. The electric power supplied by the induction heating power controller 105 passes through the excitation coil 152 and generates alternating flux for heating the heating layer 112 of the fixing belt 51.

The flux produced by the excitation coil 152 passes through core members, including the main cores 153, the centre core 154, and the fringe cores 155, going through portions of the heating layer 112 in the fixing belt 51 mostly opposite the flux generator 55 and heating the heating layer 112 by producing eddy currents therein. The heat so produced is evenly spread at all positions with respect to the width of the recording sheet.

Heat from the heated portions of the heating layer 112 is transferred to the pressing roller 53 and so on through the fixing nip 59 and the rotational driving of the fixing belt 51, such that the temperature of the fixing nip 59 increases.

The quantity, position, material, and so on for each core has been determined experimentally in order to effectively avoid having the flux produced by the excitation coil 152 leak out to the opposite side of the main cores 153 relative to the excitation coil 152, affecting the thermo-electric conversion elements 56 located on the opposite side (i.e., to prevent malfunctions).

The thermistor 58 is a sensor detecting the temperature of the fixing belt 51 and transmitting a detection signal to the control unit 6. The control unit 6 detects the current temperature of the fixing belt 51 in the detection signal from the thermistor 58, and accordingly controls the electric power supplied to the excitation coil 152 so as to maintain the fixing nip 59 at a target fixing temperature. This control is handled by the induction heating power controller 105.

Accordingly, when the recording sheet S passes through the fixing nip 59, which is maintained at the fixing temperature, the unfixed toner on the recording sheet S is heated and pressurised so as to be thermally fixed onto the recording sheet S.

The guide plate 54 is disposed within the rotational path of the fixing belt 51 and opposite the flux generator 55 relative to the fixing belt 51, is in contact with an inner circumferential surface of the rotating fixing belt 51, guides the fixing belt 51 in the belt rotational direction, and regulates the rotational position of the fixing belt 51 (i.e., the relative positions of the fixing belt 51 and the flux generator 55).

The guide plate 54 is a plate member made of a low-resistance conductive material, such as bronze or aluminium, having a thickness of approximately 1 mm, curving along the belt rotational direction at a predetermined curvature and extending lengthwise along the width direction W, and fixed at both width-wise ends to the non-diagrammed frame.

The guide plate 54 and the magnetic adjuster alloy layer 111 of the fixing belt 51 enable prevention of an excessive increase in temperature when several small recording sheets S are printed in succession.

That is, during printing, the temperature of a region P at each width-wise edge of the fixing belt 51 through which the small recording sheet S does not pass (i.e., non-passing region), and which thus does not have heat captured by the recording sheet S, exceeds the fixing temperature reaches the Curie point, whereupon the magnetic adjuster alloy layer 111 changes from a magnetic body to a non-magnetic body within the non-passing region P. Once the magnetic adjuster alloy layer 111 changes into the non-magnetic body in the non-passing region P, the flux from the flux generator 55 in the changed region more easily passes from the heating layer 112 of the fixing belt 51 through the magnetic adjuster alloy layer 111 and on to the guide plate 54.

Flux is produced in a portion of the guide plate 54 corresponding to the non-passing region P in a direction cancelling out the flux passing through the region. This flux production constrains the heating of the portion of the heating layer 112 in the fixing belt 51 corresponding to the non-passing region P (i.e., automatic temperature control).

The effect of this automatic temperature control function is to prevent the temperature of the portion corresponding to the non-passing region P from greatly exceeding the Curie point, which in turn prevents damage to the fixing belt 51 from an excessive increase in temperature.

No particular limitation is intended to the above temperature, provided that the Curie temperature serves to prevent an excessive increase in temperature. No particular limitation is intended to the aforementioned material for the magnetic adjuster alloy layer 111. The appropriate predetermined temperature for the configuration of the fixing unit 5 has been determined in advance through experimentation, and the materials and so on for the magnetic adjuster alloy layer 111 are determined so as to produce the change in magnetism at the predetermined temperature.

The thermo-electric conversion elements 56 are each made up of a P-type semiconductor element paired with an N-type semiconductor element, forming a thermo-electric conversion device producing thermo-electric power through the Seebeck effect, in accordance with the difference in temperature between the hot side (i.e., the side that is heated) and the cool side (i.e., the side that is cooled). Each thermo-electric conversion element 56 includes at least one pair of the P-type semiconductor element and the N-type semiconductor element. The thermo-electric conversion elements 56 are series-connected to a non-diagrammed power source line. The configuration of the series circuit is described later.

The thermo-electric conversion elements 56 are provided on the bobbins 161, which are on the base 151.

Figure 5:
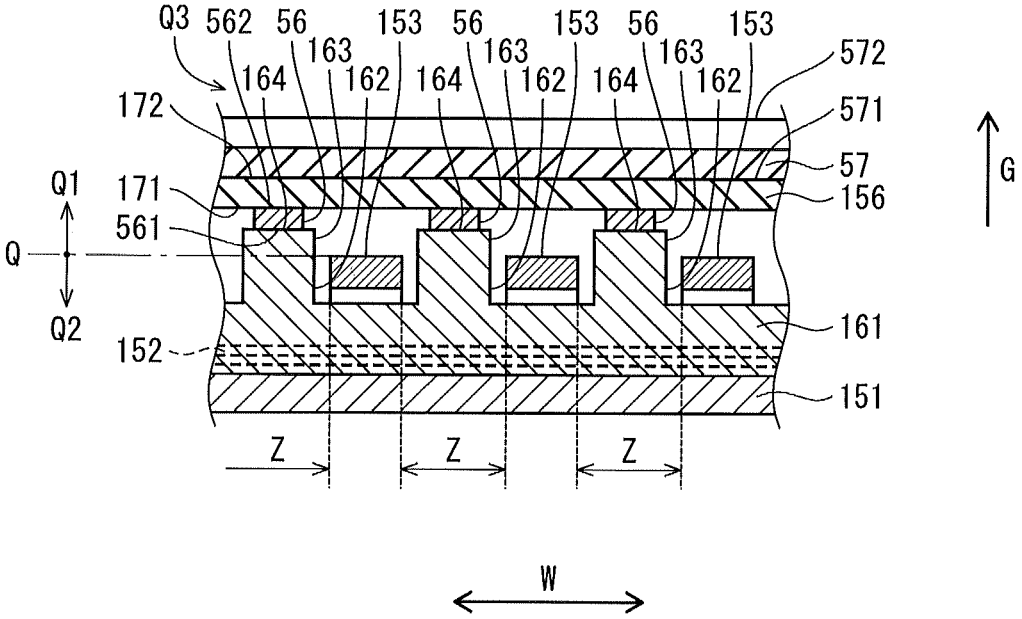
FIG. 5 is a cross-sectional view taken along line F-F of FIG. 3.

FIG. 5 is a cross-sectional view taken along line F-F of FIG. 3, depicting the base 151, the main cores 153, the thermo-electric conversion elements 56, the case cover 156, and the heat sink 57. The wiring portion of the excitation coil 152 is indicated in dashed lines.

As shown, the bobbins 161 on the base 151 each have extensions 162 provided at (spacing) intervals Z, passing through the space between every two neighbouring main cores 153 with respect to the width direction W and each having tips 163 located farther from the excitation coil 152 than the main cores 153 with respect to the arrow G.

The extensions 162 are each formed as a portion of one of the bobbins 161 so as to have a T-shaped cross-section (see FIG. 4A) and having the tips 163 formed widely thereon.

Each thermo-electric conversion element 56 is supported by being sandwiched between the base 151 and the case cover 156, so as to have a hot face 561 (i.e., the side that is heated, also termed a heat-absorbing face) in contact with a top face 164 of the tip 163, and a cool face 562 (i.e., the side that is cooled, also termed a heat-dissipating face) in contact with a back face 171 of the case cover 156 (i.e., the inner face). The supporting is through an adhesive, fastening, or similar.

As shown in FIGS. 3, 4A, 4B, and 5, the case cover 156 is made of resin, aluminium, and so on, and is affixed to the base 151 so as to cover components disposed on the face 159 of the base 151, such as the excitation coil 152, the main cores 153, the thermo-electric conversion elements 56, and so on.

The heat sink 57 is elongated and oriented along the width direction W, and is affixed by adhesive, by fastening, or the like to a front face 172 of the case cover 156 (i.e., an outer face) at two separate positions along the belt rotational direction, so as to be opposite a row of the thermo-electric conversion elements 56 along the width direction W relative to the case cover 156.

(4) Thermo-Electric Conversion by Thermo-Electric Conversion Elements 56

Once the electric power supplied to the excitation coil 152 causes flux to be produced in the excitation coil 152, the heating of the heating layer 112 in the fixing belt 51, as described above, produces Joule heating in the excitation coil 152 due to the passage of electricity.

The heat produced in the excitation coil 152 is transmitted to the hot face 561 of each thermo-electric conversion element 56 through the extension 162 of the bobbins 161, which are in direct contact with the excitation coil 152. Accordingly, a temperature increase occurs on the hot face 561 of each thermo-electric conversion element 56.

Conversely, the cool face 562 of each thermo-electric conversion element 56 is in contact with the heat sink 57 through the case cover 156, such that unlike the hot face 561, no increase in temperature occurs due to the heat dissipation effect by the heat sink 57.

Accordingly, a temperature difference is produced between the hot face 561 and the cool face 562 of each thermo-electric conversion element 56, and power is produced in accordance with that temperature difference.

For example, suppose that the approximate temperatures are 120° C. for the circuit portion of the excitation coil 152 and 25° C. for the vicinity of the fixing unit 5 (i.e., the outside atmosphere). The approximate temperatures of the other components are then 110° C. for the bobbins 161, 80° C. for the extension 162 of each bobbin 161, 75° C. for the hot face 561 of each thermo-electric conversion element 56, 45° C. for the cool face 562 of each thermo-electric conversion element 56, 40° C. for an attaching (root) portion 570 fixing the heat sink 57 to the case cover 156, and 35° C. for a tip 572 of the heat sink 57. As such, there is a temperature difference of approximately 30° C. between the hot face 561 and the cool face 562 of each thermo-electric conversion element 56.

Assuming that one of the thermo-electric conversion elements 56 is able to generate 1 W of power when the temperature difference is 30° C., then using ten of the thermo-electric conversion elements 56 connected in series enables production of 10 W of power.

In FIG. 5, with respect to the direction of arrow G, a first region Q1 is defined as the side where the thermo-electric conversion elements 56 are located, and a second region Q2 is defined as located between the first region Q1 and the side where the excitation coil 152 is located, with the main cores 153 being in the middle and a line Q separating the regions. The core members, including the main cores 153 and the fringe cores 155, serve as magnetic path shaping members that concentrate the flux generated from the excitation coil 152 and thus increase flux density, and that shape the magnetic path such that the flux does not extend into the first region Q1.

Accordingly, when flux is produced by the excitation coil 152, the thermo-electric conversion elements 56 disposed in the first region Q1, i.e., at positions farther from the excitation coil 152 than the main cores 153, are not affected by the flux. Thus, the flux is prevented from causing any malfunction or decrease in thermo-electric conversion efficacy of the thermo-electric conversion elements 56.

Also, the bobbins 161 are made of the thermally conductive electrically insulating resin and serve as thermally conductive members connecting the excitation coil 152 to the hot face 561 of each thermo-electric conversion element 56. Thus, the heat produced by the excitation coil 152 is effectively transmitted to the thermo-electric conversion elements 56, thereby increasing the thermo-electric conversion efficiency.

Also, placing the thermo-electric conversion elements 56 within the first region Q1 but as close to the excitation coil 152 as possible serves to reduce the length of the extension 162 of each bobbin 161, thereby further increasing the efficacy of heat transmission from the excitation coil 152 to the thermo-electric conversion elements 56.

Furthermore, when a conductive body is used for the bobbins, arranging a portion of the conductive body within the second region Q2 disrupts the flux within the second region Q2, causes some of the electric power supplied to the excitation coil 152 to be used by the bobbins for heating, poses a risk of increased temperature in the fixing belt 51, and so on. However, the bobbins 161 are electrically insulating, thus avoiding these problems and increasing the efficacy of heating in the fixing belt 51 by electromagnetic induction heating.

Also, a temperature increase is prevented in the excitation coil 152, which increases thermal efficacy of the fixing belt 51.

Figure 6:
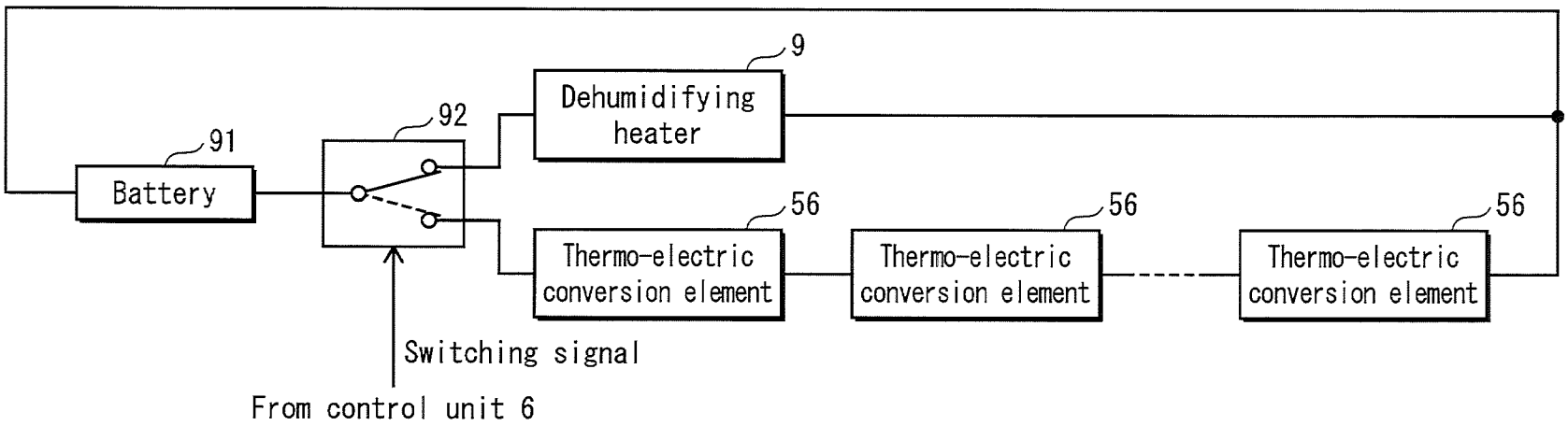
FIG. 6 illustrates an example of a circuit configuration that includes a plurality of thermo-electric conversion elements connected in series.

(5) Circuit Configuration Including Multiple Thermo-Electric Conversion Elements FIG. 6 illustrates an example of a circuit configuration that includes a plurality of thermo-electric conversion elements 56 connected in series. As shown, the thermo-electric conversion elements 56 and a battery 91 are connected in series in a first series circuit, the battery 91 and the dehumidifying heater 9 are connected in series in a second series circuit, and a switch 92 operated by a switching signal from the control unit 6 switches between the first series circuit and the second series circuit.

Here, the battery 91 is a lithium-ion battery serving as storage (of charge) for the power produced by the thermo-electric conversion elements 56 that are connected in series, and to discharge the charged power.

The control unit 6 detects the humidity in the vicinity of the paper feed cassette 41 based on the detection signal from the humidity sensor 47 (see FIG. 1). When the detected humidity is equal to or less than a predetermined value, the control unit 6 switches to the first series circuit (shown in the dashed line). Conversely, when the detected humidity exceeds the predetermined value, the control unit 6 switches to the second series circuit (shown in the solid line).

Accordingly, in a normal environment without high humidity near the paper feed cassette 41, the power produced by the thermo-electric conversion elements 56 is stored in the battery 91. When a change occurs in the environment of the printer 1 such that high humidity is present within the paper feed cassette 41, the battery 91 discharges power to the dehumidifying heater 9 so as to eliminate humidity from the recording sheet S. Using the power in the battery 91 to operate the dehumidifying heater 9 reduces commercial power consumption by not requiring the use of commercial power.

The above describes charging the battery 91 with power obtained through thermo-electric conversion by the thermo-electric conversion elements 56 and supplying power discharged from the battery 91 to the dehumidifying heater 9. However, no particular limitation to this configuration is intended. For example, the power generated by the thermo-electric conversion elements 56 may also be used to drive a (non-diagrammed) cooling fan disposed within the device.

(Variations)

Although an Embodiment of the disclosure has been described above, no particular limitation is intended thereto. The following Variations may also be applied.

(1) In the above-described Embodiment, an example is described in which the case cover 156 and the heat sink 57 serve as heat dissipating members for cooling the cool face 562 of each thermo-electric conversion element 56, such that the cool face 562 of each thermo-electric conversion element 56 is in contact with the heat sink 57 through the case cover 156. However, no such limitation is intended. A direct-contact configuration may also be used.

Figure 7A:
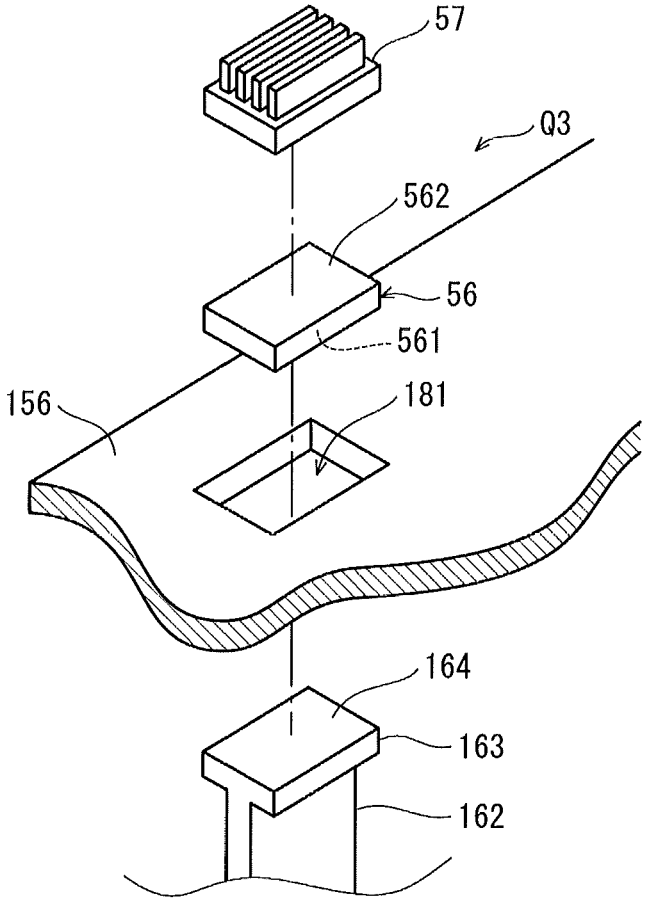
FIG. 7A is a schematic perspective view diagram of a configuration in which a heat-dissipating face of the thermo-electric conversion element is in direct contact with a heat sink.
Figure 7B:
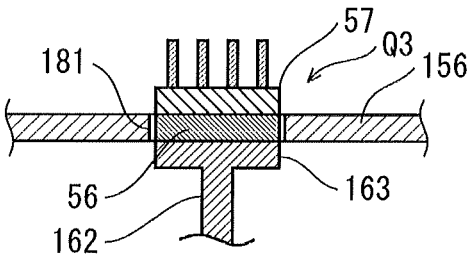
FIG. 7B is a cross-sectional view of the same.

FIG. 7A is a schematic perspective view of a configuration in which the cool face 562 of each thermo-electric conversion element 56 is in direct contact with the heat sink 57. FIG. 7B is a cross-sectional view of the same.

As shown, one of the thermo-electric conversion elements 56 is arranged in a through-hole 181 provided in the case cover 156, such that the hot face 561 of the thermo-electric conversion element 56 is in surface contact with the top face 164 of the tip 163 on the extension 162 of the bobbins 161, and the cool face 562 of the thermo-electric conversion element 56 is in surface contact with the heat sink 57. This thermo-electric conversion element 56 is thus held between the extension 162 and the heat sink 57.

When the heat sink 57 is used as the heat dissipating member in this manner, then providing a peripheral space Q3 that exposes the heat sink 57 to the outside through the through-hole 181 in the case cover 156 facilitates cooling of the cool face 562 of the thermo-electric conversion element 56, increases the temperature difference between the hot face 561 and the cool face 562 of the thermo-electric conversion element 56, and thus facilitates thermo-electric conversion.

Also, a layer of adhesive or similar may be applied between the cool face 562 of each thermo-electric conversion element 56 and the heat sink 57. In such a case, the adhesive serves as part of the thermally conductive member. This is similar to the configuration described in the Embodiment, where an adhesive layer is disposed between the cool face 562 of each thermo-electric conversion element 56 and the back face 171 of the case cover 156, and between the bobbins 161 and the excitation coil 152.

FIGS. 7A and 7B show only one of the thermo-electric conversion elements 56. However, the same configuration may also be applied to the other thermo-electric conversion elements 56.

Also, the heat sink 57 may not be provided when the case cover 156 alone is able to cool the cool face 562 of the thermo-electric conversion element 56. Furthermore, a component other than the case cover 156 and the heat sink 57 may also be used for heat dissipation.

When, for example, the cool face 562 of each thermo-electric conversion element 56 is exposed to the peripheral space Q3 through the through-hole 181 in the case cover 156, cooling of the cool face 562 is produced. This configuration does not require the heat dissipating member. Further, a configuration without the case cover 156 facilitates cooling of the cool face 562 by direct exposure of the thermo-electric conversion elements 56 through the peripheral space Q3.

(2) In the above-described Embodiments, a configuration is described in which the main cores 153 and the thermo-electric conversion elements 56 are arranged along a sheet width direction W at offset positions so as not to overlap with respect to the sheet width direction W. However, no such limitation is intended. For example, with reference to FIG. 5, the thermo-electric conversion elements 56 may be arranged directly above the main cores 153. In such a configuration, the tip 163 of the extension 162 provided on each bobbin 161 acting as the thermally conductive member extends further along the sheet width direction W to reach a position directly above one of the main cores 153, and this enables the hot face 561 of the thermo-electric conversion elements 56 to be disposed on the extension.

Although the main cores 153 and the fringe cores 155 are used as core member, no particular limitation is intended regarding the quantity, shape, arrangement, and so on of each core type.

Also, the above describes the flux from the excitation coil 152 as not extending outside the first region Q1. However, in a situation where the flux does slightly extend outside the first region Q1, the placement of the thermo-electric conversion elements 56 at a position farther from the excitation coil 152 than the flux-collecting core members (i.e., on the far side of the excitation coil 152 with the core members therebetween) enables better constraint of the effect of flux and prevention of malfunctions or reduced thermo-electric conversion efficacy due to the flux, in comparison with a configuration where, for example, the excitation coil 152 is in direct contact with the thermo-electric conversion elements 56 within the second region Q2, which is closer to the excitation coil 152 than the core members.

In such a case, efficiently transporting the heat from the excitation coil 152 to the thermo-electric conversion elements 56 is beneficially achieved by arranging the thermo-electric conversion elements 56 as close to the excitation coil 152 as possible while remaining in an area without substantial influence from the flux.

(3) In the above-described Embodiments, the bobbins 161 are described as serving as thermally conductive members. However, no such limitation is intended. Another member may be separately provided, as long as this member is connected to the excitation coil 152 and to the hot face 561 of the thermo-electric conversion elements 56, and is able to transport the heat from the excitation coil 152 to the thermo-electric conversion element 56.

(4) In the above-described Embodiment, the fixing device and the image forming device of the disclosure are described as being implemented in a tandem colour printer. However, no such limitation is intended. A monochromatic printer may also be used.

The present disclosure may further be applied to any fixing device or image forming device incorporating the fixing device employing induction heating to heat a fixing belt or the like that includes a heating layer, such as a copier, FAX machine, or multi-function peripheral (MFP).

Also, the fixing roller 52 is described as being disposed within the fixing belt 51. However, no such limitation is intended. For instance, a pressing pad may be provided within the fixing belt 51 and press the pressing roller 53 through the fixing belt 51, thereby forming the fixing nip 59 between the fixing belt 51 and the pressing roller 53.

Also, the fixing belt 51 is described as including a heated body heated through induction heating. However, no such limitation is intended. For instance, the fixing belt may be absent while a heating layer is provided on the fixing roller, such that the fixing roller is the heated body. Alternatively, the guide plate 54 may be the heated body.

Furthermore, no particular limitation is intended regarding the shape, size, material, and so on for the base 151, the excitation coil 152, the main cores 153, and the case cover 156. Likewise, no limitation is intended to the quantity, size, shape, and so on of the thermo-electric conversion elements 56 and the heat sink 57. Further, although the bobbins are described as being electrically insulating, an electrically conductive material may instead be used when the fixing power has no influence on heating characteristics, including on the heating characteristics of the fixing belt 51.

(5) In the above-described Embodiments, an example is given in which the disclosure is applied to a fixing device in an image forming device. However, no limitation to a fixing device is intended. The disclosure is also generally applicable to other induction heating devices, such as an induction heating cooking device or the like, where a heating body is heated through induction heating.

For instance, in an induction heating cooking device, a heat target such as a bowl is set on a top plate, under which is disposed an excitation coil and one or more core members of ferrite or the like. The core member serves as a path for the flux from the excitation coil, forming a magnetic circuit such that the flux does not extend below the core member (i.e., the flux is obstructed). At least one thermo-electric conversion element is then arranged below the core member, along with a thermally conductive member connecting the thermo-electric conversion element to the excitation coil.

Also, the above-described Embodiment and variations may be freely combined within the realm of possibility. Provided that the effects of the disclosure are achieved, the components and materials of the fixing unit and so on may be freely replaced with others.

SUMMARY

The above-described Embodiment and Variations represent one aspect for solving the problem discussed in the related art. The Embodiments and Variations are summarised below.

That is, in one aspect, a fixing device thermally fixing an unfixed image onto a sheet through heat of a heating body that is heated through electromagnetic induction, the fixing device comprising: an excitation coil generating flux for heating the heating body; one or more core members disposed opposite the heating body with respect to the excitation coil; a thermo-electric conversion element disposed farther from the excitation coil than the core members; and a thermally conductive member connected to the excitation coil and to a heat-absorbing face of the thermo-electric conversion element, transferring heat from the excitation coil to the thermo-electric conversion element.

In another aspect, the core members may be disposed in a row with separation from each other, the thermally conductive member is a bobbin around which the excitation coil is wound, the bobbin is provided with an extension extending toward a space between a neighbouring pair of the core members, the extension has a tip passing through the space so as to be arranged farther from the excitation coil than the core members, and the thermo-electric conversion element is affixed to a portion of the tip of the extension.

In further aspect, a base may be disposed with separation from the heating body, the bobbin being provided on a face of the base opposite the heating body, and the base and the bobbin are incorporated as one, using a common material.

In an additional aspect, the excitation coil may be elongated with respect to a width direction of the sheet, and the bore members may be aligned with the width direction of the sheet, with separation therefrom.

Furthermore, the thermally conductive member may also be electrically insulating.

Additionally, the heating body may be a rotating body, and the core members may be elongated with respect to a circumferential direction of the rotating body.

Further still, the fixing device may include a heat dissipation member, a heat-dissipating face of the thermo-electric conductive member being in contact with the heat dissipation member.

In addition, the heat dissipation member may be a case cover of the fixing device.

Also, the heat dissipation member may include, in addition to the case cover, a heat sink provided on the case cover, opposite the thermo-electric conversion element.

Further, the fixing device may include a case cover having a through-hole, the heat dissipation member being a heat sink exposed to an external peripheral space through the through-hole in the case cover.

In yet another aspect, an image forming device forming an unfixed image on a sheet, the image forming device having a fixing unit thermally fixing the unfixed image onto the sheet through heat of a heating body that is heated through electromagnetic induction, the fixing unit comprising: an excitation coil generating flux for heating the heating body; one or more core members disposed opposite the heating body with respect to the excitation coil; a thermo-electric conversion element disposed farther from the excitation coil than the core members; and a thermally conductive member connected to the excitation coil and to a heat-absorbing face of the thermo-electric conversion element, transferring heat from the excitation coil to the then no-electric conversion element.

Also, an induction heating device heating a heating body through electromagnetic induction, comprising: an excitation coil generating flux for heating the heating body; one or more core members disposed opposite the heating body with respect to the excitation coil; a thermo-electric conversion element disposed farther from the excitation coil than the core members; and a thermally conductive member connected to the excitation coil and to a heat-absorbing face of the thermo-electric conversion element, transferring heat from the excitation coil to the thermo-electric conversion element.

According to the above configuration, the effect of flux from the excitation coil on the thermo-electric conversion element is constrained, and the heat from the excitation coil is transferred to the thermo-electric conversion element by a thermally conductive member. Thus, the thermo-electric efficacy of the thermo-electric conversion elements is enhanced by making effective use of the heat from the excitation coil.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. A fixing device thermally fixing an unfixed image onto a sheet through heat of a heating body that is heated through electromagnetic induction, the fixing device comprising:

an excitation coil generating flux for heating the heating body;

one or more core members disposed opposite the heating body with respect to the excitation coil;

a thermo-electric conversion element disposed farther from the excitation coil than the core members; and a thermally conductive member connected to the excitation coil and to a heat-absorbing face of the thermo-electric conversion element, transferring heat from the excitation coil to the thermo-electric conversion element, wherein the core members are disposed in a row with separation from each other, the thermally conductive member is a bobbin around which the excitation coil is wound, the bobbin is provided with an extension extending toward a space between a neighbouring pair of the core members, the extension has a tip passing through the space so as to be arranged farther from the excitation coil than the core members, and the thermo-electric conversion element is affixed to a portion of the tip of the extension.

2. The fixing device of claim 1, further comprising a base disposed with separation from the heating body, wherein the bobbin is provided on a face of the base opposite the heating body, and the base and the bobbin are incorporated as one, using a common material.

3. The fixing device of claim 1, wherein the excitation coil is elongated with respect to a width direction of the sheet, and the core members are aligned with the width direction of the sheet, with separation therefrom.

4. The fixing device of claim 1, wherein the thermally conductive member is also electrically insulating.

5. The fixing device of claim 1, wherein the heating body is a rotating body, and the core members are elongated with respect to a circumferential direction of the rotating body.

6. The fixing device of claim 1, further comprising a heat dissipation member, wherein a heat-dissipating face of the thermo-electric conductive member is in contact with the heat dissipation member.

7. The fixing device of claim 6, wherein the heat dissipation member is a case cover of the fixing device.

8. The fixing device of claim 7, wherein the heat dissipation member includes, in addition to the case cover, a heat sink provided on the case cover, opposite the thermo-electric conversion element.

9. The fixing device of claim 6, further comprising a case cover having a through-hole, wherein the heat dissipation member is a heat sink exposed to an external peripheral space through the through-hole in the case cover.

10. The fixing device of claim 1, wherein the heating body forms with a pressing roller of the fixing device a fixing nip through which the sheet is fed in a vertical direction of the fixing device, and the thermo-electric conversion element is provided above the fixing nip in the vertical direction.

11. The fixing device of claim 1, wherein the thermally conductive member is T-shaped.

12. The fixing device of claim 11, wherein a top of the T-shaped thermally conductive member supports the thermo-electric conversion element, and a bottom of the T-shaped thermally conductive member contacts the excitation coil.

13. An image forming device forming an unfixed image on a sheet, the image forming device having a fixing unit thermally fixing the unfixed image onto the sheet through heat of a heating body that is heated through electromagnetic induction, the fixing unit comprising:

an excitation coil generating flux for heating the heating body;

one or more core members disposed opposite the heating body with respect to the excitation coil;

a thermo-electric conversion element disposed farther from the excitation coil than the core members; and a thermally conductive member connected to the excitation coil and to a heat-absorbing face of the thermo-electric conversion element, transferring heat from the excitation coil to the thermo-electric conversion element, wherein the core members are disposed in a row with separation from each other, the thermally conductive member is a bobbin around which the excitation coil is wound, the bobbin is provided with an extension extending toward a space between a neighbouring pair of the core members, the extension has a tip passing through the space so as to be arranged farther from the excitation coil than the core members, and the thermo-electric conversion element is affixed to a portion of the tip of the extension.

14. An induction heating device heating a heating body through electromagnetic induction, comprising:

an excitation coil generating flux for heating the heating body;

one or more core members disposed opposite the heating body with respect to the excitation coil;

a thermo-electric conversion element disposed farther from the excitation coil than the core members; and a thermally conductive member connected to the excitation coil and to a heat-absorbing face of the thermo-electric conversion element, transferring heat from the excitation coil to the thermo-electric conversion element, wherein the core members are disposed in a row with separation from each other, the thermally conductive member is a bobbin around which the excitation coil is wound, the bobbin is provided with an extension extending toward a space between a neighbouring pair of the core members, the extension has a tip passing through the space so as to be arranged farther from the excitation coil than the core members, and the thermo-electric conversion element is affixed to a portion of the tip of the extension.

* * * * *